US007955138B1

(12) United States Patent
Zhu

(10) Patent No.: US 7,955,138 B1
(45) Date of Patent: Jun. 7, 2011

(54) ELECTRICAL CONNECTOR WITH IMPROVED HOUSING FOR STAGGERING CONTACT

(75) Inventor: Yu Zhu, Shenzhen (CN)

(73) Assignee: Hon Hai Precision Ind. Co., Ltd., New Tapei (TW)

( * ) Notice: Subject to any disclaimer, the term of this patent is extended or adjusted under 35 U.S.C. 154(b) by 0 days.

(21) Appl. No.: 12/880,290

(22) Filed: Sep. 13, 2010

(30) Foreign Application Priority Data

Apr. 13, 2010 (CN) ..... 2010 2 0160564

(51) Int. Cl.
*H01R 17/00* (2006.01)

(52) U.S. Cl. ..... 439/660; 439/924.1

(58) Field of Classification Search ..... 439/60, 439/660, 924.1
See application file for complete search history.

(56) References Cited

U.S. PATENT DOCUMENTS 4,806,103 A * 2/1989 Kniese et al. ..... 439/60
5,993,263 A * 11/1999 Sampson ..... 439/660
6,699,049 B1 * 3/2004 Wu ..... 439/79

* cited by examiner

*Primary Examiner* — Tho D Ta
(74) *Attorney, Agent, or Firm* — Wei Te Chung; Andrew C. Cheng; Ming Chieh Chang

(57) ABSTRACT

An electrical connector includes an insulative housing and a plurality of first contacts received in the housing. The insulative housing includes a base face and a number of first receiving grooves recessed perpendicularly from the base face. Each first contact has base portions assembled to the first contact groove. A first shifting portion defined with a first shifting direction is set on an inside face of each first contact groove.

8 Claims, 5 Drawing Sheets

ELECTRICAL CONNECTOR WITH IMPROVED HOUSING FOR STAGGERING CONTACT

BACKGROUND OF THE INVENTION

1. Field of the Invention

The present invention relates to an electrical connector, and more particularly to an electrical connector having easy to assembly staggered contacts.

2. Description of Related Art

In view of the increasingly improved operating efficiency of central processing units of electronic products, data transmission speeds of peripheral equipment have to be increased as well. Particularly, standard peripheral equipment, such as hard disks, optical disks, etc., are required to have faster data transmission speeds. Therefore, interfaces, which can transmit data at high speeds, have gradually become mainstream interfaces for electrically connecting electronic products and peripheral equipment.

An electrical connector, such as those meeting the Serial ATA specification, are designed to supply electric currents having different voltage values while being capable of transmitting electric signal data at high speeds, and can even be coupled to or detached from peripheral equipment when an electronic device is in an "on" state, achieving the so-called "hot plugging" effect.

However, in order to achieve the hot plugging function, the arrangement of conductive terminals in an electrical connector is generally modified to have different lengths. That is, for a conductive terminal dedicated to grounding, the length of its contact portion, which is disposed to electrically contact a corresponding electrical connector, is longer than that of contact portions of other conductive terminals that are dedicated to signal transmission. Thus, during the process of inter-engagement of the electrical connector and the corresponding electrical connector, the grounding portion will achieve electrical connection first. On the contrary, during the process of disengagement of the electrical connector from the corresponding electrical connector, the grounding portion will be the last to achieve electrical disconnection, thereby ensuring stability of data transmission.

Since conductive terminals of at least two different lengths are required, in the case of the currently adopted manufacturing process of using a machine to assemble the same to an insulating housing by "strip insertion," it is commonly to punch long and short conductive terminals from the same material strip. However, it takes time to replace and adjust the molds. Another common way is to punch conductive terminals with same shape and insert them to different depths, but it occupies a stacked inter-engagement distance which takes a broad insulative base. One more problem existed in both proposals is that conductive terminals would move back in the contact receiving slot because of parallel contact insert direction and mating direction.

Hence, an improved electrical connector is desired to overcome the above problems.

BRIEF SUMMARY OF THE INVENTION

The present invention provides an electrical connector including an insulative housing and a plurality of first contacts received in the housing. The insulative housing includes a base face and a number of first receiving grooves recessed perpendicularly from the base face. Each first contact has base portions assembled to the first contact groove. A first shifting portion defined with a first shifting direction is set on an inside face of each first contact groove.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
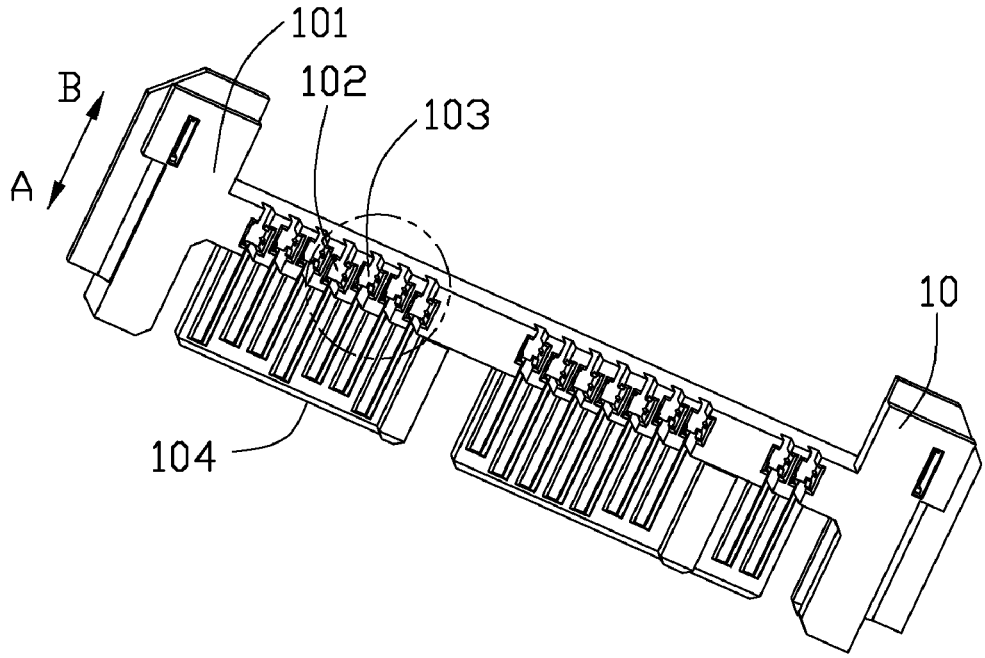
FIG. 1 is a perspective view of the electrical connector.

Reference will now be made to the drawing figures to describe the preferred embodiment of the present invention in detail.

FIGS. 1 to 5 illustrate an electrical connector 100 known as a Serial Advanced Technology Attachment (Serial ATA) connector according to an embodiment of the present invention, which includes an insulative housing 10, a plurality of contacts 20 received in the housing 10 and a pair of board locks 30 for retaining the connector 100 to a circuit board (not shown).

Figure 2:
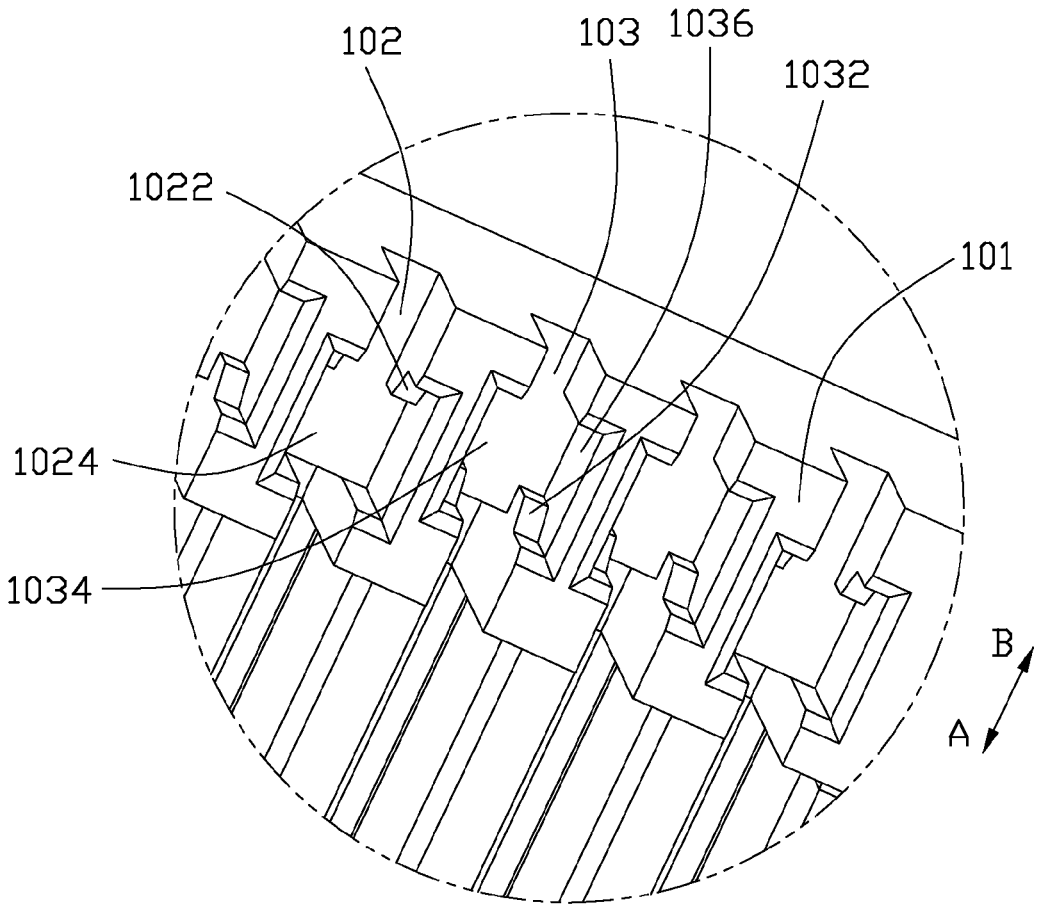
FIG. 2 is an enlarged view of a circled portion of FIG. 1.

Referring to FIGS. 1 and 2, the insulative housing 10 has a base face 101, a number of parallel first receiving grooves 102 and second receiving grooves 103 recessed perpendicularly from the base face 101 so that the contacts 20 are assembled to the grooves from the base face 101. Each of said receiving grooves has a retaining section 1024, 1034 with a larger dimension in an orientation direction along which said receiving grooves are arranged than other portions of the corresponding groove. The retaining sections of the first receiving grooves and the second receiving grooves has a same dimension in the first orientation and a second orientation perpendicular along which each groove extends, while the retaining sections of the first receiving grooves are offset from the retaining sections of the second receiving grooves in the orientation direction, i.e., the retaining portions of the first receiving groove are located in a row before that of the second receiving grooves.

Each retaining section 1024 of first grooves 102 has a first shifting portion 1022 therein projecting forward from a rear inside face, each retaining portion of the second groove 103 has a second shifting portion 1032 therein projecting rearward from a front inside face. The shifting portions 1022, 1032 project along the shift direction of the retaining section, for example in this embodiment, the retaining portions 1024 of the first grooves 102 shift in a first shifting direction A which is one direction of the second orientation so that the first shifting portion 1022 shifting in the shifting direction A. Similarly, the shifting portion 1032 shift in a second shifting direction B opposite to the direction A. Both of the first shifting portion 1022 and the second shifting portion 1032 are ramps away from the base face 101.

Figure 3:
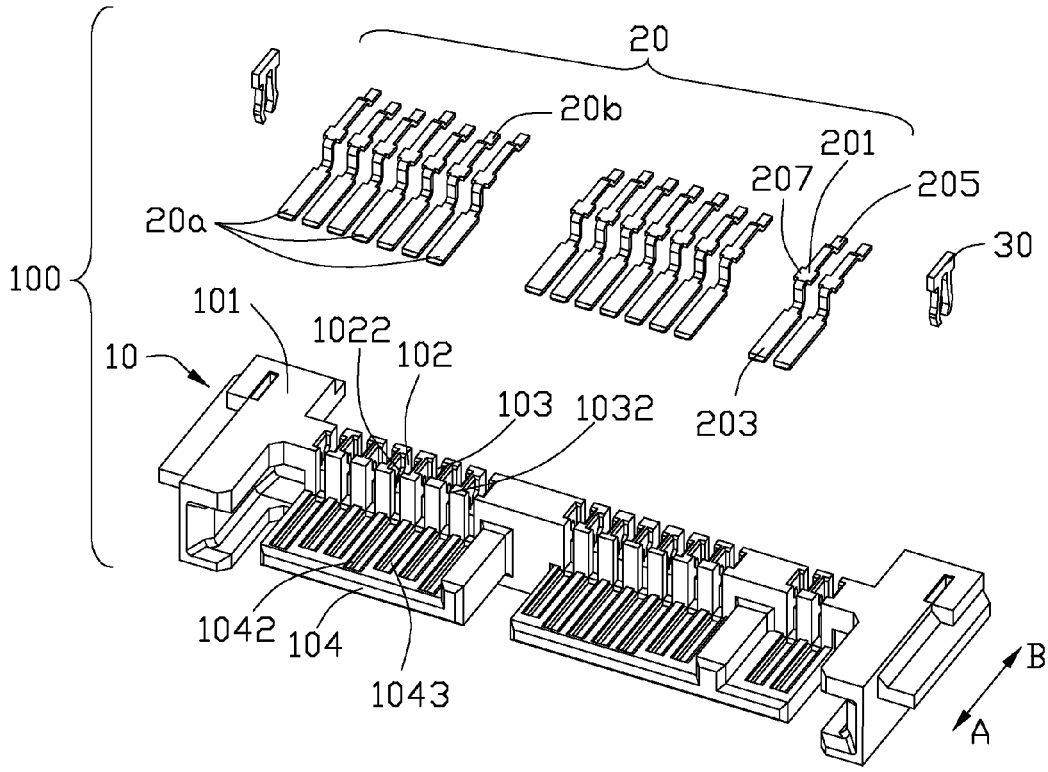
FIG. 3 is an exploded view of the electrical connector.
Figure 4:
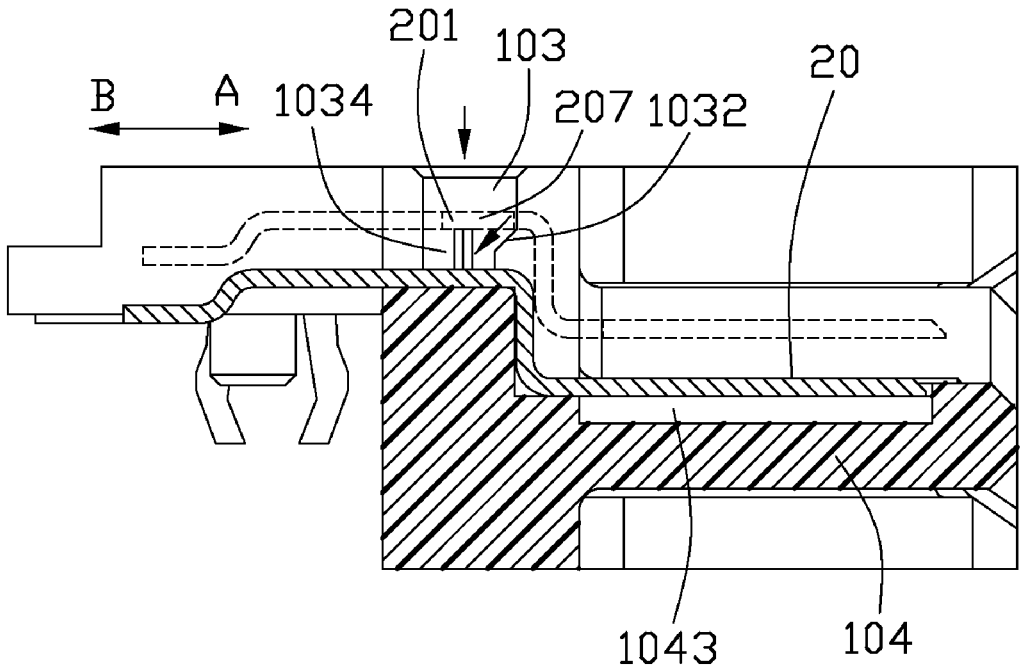
FIG. 4 is a schematic cross section view of the electrical connector showing the contact assembling process.
Figure 5:
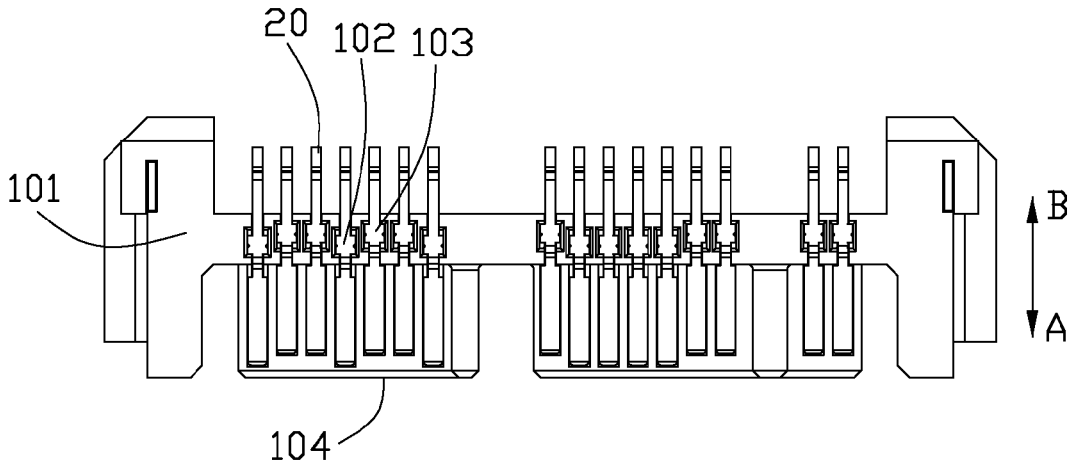
FIG. 5 is a top view of the electrical connector.

Referring to FIGS. 3 and 4, the insulative housing 10 include a base portion 11 and two side-by-side spaced tongue portions 104 extending from a front face of the base portion, the first and second receiving grooves 102,103 being located at and through the base portion 11 in the second orientation. Each tongue portion defines first mating grooves 1042 and second mating grooves 1043 extending along the second orientation to accommodate the first and second receiving grooves 102, 103 respectively. All contacts 20 are formed in a row by one material strip (not shown) and with the same shape. Contacts 20 that are assembled to corresponding first and second receiving grooves 102,103 are defined as first contacts 20*a* and second contacts 20*b*. Each contact 20 has a base portion 201 received and retained in the receiving groove, a plate contacting portion 203 received in the mating groove and exposing on one side of the tongue portion 104 and a solder tail 205 exposing to a rear face of the base portion 11. The base portion has widen portions 207 at opposite sides thereof, such as barbs, which are in the retaining section 1024,1034 to interfere with the inside walls of the receiving groove. Please note, the first mating grooves 1042 are longer than the second mating grooves 1043 so as to receive corresponding contacts with longer contacting portions. The first receiving grooves are disposed forward compared with the second receiving grooves.

Best shown in FIG. 4, contacts assembly process will now be illustrated. The contacts 20 are firstly put into the receiving grooves until front edges of the widen portions 207 are located at the tops of the shifting portion wherein the rear edges of the widen portions space from the inside face opposite to the shifting portions. When the contacts 20 are pressed down further, the widen portions 207 are guided to move rearward or inwards along the second shifting direction until the base portions arrive at a bottom of the receiving grooves. For example as shown in FIG. 4, the retaining portion 201 slide downwards and rearwards by the second shifting portion 1032 until the widen portion 207 interferencely engages with two side walls 1036 paralleling to the second shifting direction B and the rear edge of the widen portion abuts against the inside face opposite to the shifting portions 1032. Likewise, contact 20 that used to receive in the first contact groove 102 is assembled in the same way except for shifting along the opposite first shift direction A.

The contacts 20 are formed in a metal sheet and connecting with two metal tapes at two opposite ends of the contacts, i.e., the contacting portion and the tail portion. The widen portions 207 are arranged in one row and be inserted to the retaining sections. Please notes, the widen portions of the contacts 20 are just located between the first and second shifting portions. Then the metal tapes are taken away, the base portions 201 are pressed downwards by tools and move in different shifting directions. Those contacts received in the longer first mating grooves 1042 will arrive forwards than others since corresponding base portions shift forward, even if the contacting portions of all the contacts have a same length in this embodiment. In conventional art, some of the contacts served as grounding pins are longer than others in the contacting portions to ensure good electrical performance, which will waste metal material.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing comprising a base face and a number of first receiving grooves recessed perpendicularly from the base face; and a plurality of first contacts with base portions assembled to the first receiving grooves; wherein a first shifting portion projecting in a first shifting direction defined on an inside face of each first receiving groove;

wherein the first shifting portion is a ramp away from the base face;

wherein the first shifting direction is parallel to the base face;

wherein the base face further defines a number of second receiving grooves recessed in parallel with the first receiving grooves, a plurality of second contacts assembled to the first receiving grooves, and a second shifting portion projecting in a second shifting direction opposing to the first shifting direction is defined on an inside face of each second receiving groove;

wherein the second shifting portion is a ramp away from the base face.

2. The electrical connector as claimed in claim 1, wherein the insulative housing further forms a tongue portion extending in the first shifting direction, and each first contact forms a plate finger exposed on one side of the tongue portion.

3. An electrical connector comprising:

an insulative housing comprising a base portion and a tongue portion extending forwards from the base portion, a plurality of first and second mating grooves recessed perpendicularly from the upper face of the mating tongue and first and second receiving grooves recessed perpendicularly from the upper face of the base portion accommodating with each other one by one, the first mating grooves being defined forward than the second mating grooves; and a plurality of contacts comprising contacting portion in the mating grooves, base portions in the receiving groove and tail portions;

the base portions defining widen portions at sides thereof and interferencely received in widen retaining sections of the receiving grooves; wherein the retaining sections of the first receiving groove are located forward in relative to the retaining sections of the second receiving grooves;

wherein a first shifting portion projecting in a first shifting direction paralleling to the upper face of the base portion is defined on an inside face of each first receiving groove;

wherein the first shifting portion is a ramp away from the base upper face.

4. An electrical connector comprising:

an insulative housing defining a base with a mating tongue forwardly extending therefrom in a front-to-back direction;

a plurality of contact receiving passageways formed in the housing and exposed to an exterior in a vertical direction perpendicular to said front-to-back direction, each of said contact receiving passageways including a receiving groove in the base and a mating groove in the mating tongue, said contact receiving passageways being categorized with first and second groups wherein the receiving grooves and the mating grooves of the contact receiving passageways in the first group are forwardly offset from those in the second group in said front-to-back direction; and a plurality of contacts disposed in the corresponding contact receiving passageways, respectively, said contacts being categorized with first and second sets wherein the contacts of the first set are disposed in the corresponding contact receiving passageways of the first group, respectively, and those of the second set are disposed in the corresponding contact receiving passageways of the second group; wherein each of said contacts includes a front contacting section, a middle retention section and rear tail section under condition that the front contact sections and the middle retention sections of all said contacts are same with dimension and configuration while the rear tail sections of the contacts of the first set are longer than those of the second set so as to have the front mating sections of the contacts of the first set are essentially forwardly offset from those of the second set for compliance with a complementary connector while allowing rear ends of the rear tail sections of all contacts to be terminated at a same position in said front-to-back direction for compliance with solder pads on a printed circuit board on which the connector is mounted.

5. The electrical connector as claimed in claim 4, wherein the receiving grooves are wider than the mating grooves, and the middle retention sections are wider than the front mating sections and the rear tail sections so as to have the contacts are assembled to and restrained in the corresponding contact receiving passageways in the vertical direction without moving in said front-to-back direction.

6. The electrical connector as claimed in claim 4, wherein each of said receiving grooves is equipped with a shifting portion under condition that the shifting portion of the contact receiving passageway in the first group is located on a rear side of the corresponding receiving groove while the shifting portion of the contact receiving passageway in the second group is located on a front side of the corresponding receiving groove.

7. The electrical connector as claimed in claim 4, wherein each of said contacts defines a vertical section between the front mating section and the middle retention section, and the housing defines a vertical wall between the mating groove and the receiving groove in each of said contact receiving passageways under condition that the vertical section of each contacts abuts, in the front-to-back direction, against the corresponding vertical wall in the corresponding contact receiving passageway when the contact is fully assembled into the corresponding contact receiving passageway.

8. The electrical connector as claimed in claim 4, wherein the contacts are assembled into the corresponding contact receiving passageways in the vertical direction from the exterior.

* * * * *